US006604572B2

(12) United States Patent
Kawamoto

(10) Patent No.: US 6,604,572 B2
(45) Date of Patent: Aug. 12, 2003

(54) PIPELINE DEVICE AND METHOD FOR ITS PRODUCTION, AND HEAT EXCHANGER

(75) Inventor: Takao Kawamoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/416,954

(22) Filed: Oct. 13, 1999

(65) Prior Publication Data

US 2002/0050343 A1 May 2, 2002

(30) Foreign Application Priority Data

Apr. 14, 1999 (JP) ..... 11-106324

(51) Int. Cl.[7] ..... F28F 19/02
(52) U.S. Cl. ..... 165/133; 165/134.1; 428/674
(58) Field of Search ..... 165/133, 134.1, 165/DIG. 513; 428/553, 560, 654, 674

(56) References Cited

U.S. PATENT DOCUMENTS

| | | | | | |
|---|---|---|---|---|---|
| 1,578,254 | A | * | 3/1926 | Bennett | 165/133 |
| 3,990,862 | A | * | 11/1976 | Dahl et al. | 165/133 |
| 4,093,755 | A | * | 6/1978 | Dahl et al. | 165/133 |
| 4,368,776 | A | * | 1/1983 | Negita et al. | 165/133 |
| 4,830,101 | A | * | 5/1989 | Ohara et al. | 165/133 |
| 5,732,767 | A | * | 3/1998 | Saperstein | 165/133 |
| 5,907,761 | A | * | 5/1999 | Tohma et al. | 165/133 |

FOREIGN PATENT DOCUMENTS

| | | | | |
|---|---|---|---|---|
| JP | 60-170684 | | 11/1985 | |
| JP | 61-210171 | * | 9/1986 | 165/133 |
| JP | 61-262595 | | 11/1986 | |
| JP | 62-112768 | * | 5/1987 | 165/133 |
| JP | 63-34495 | * | 2/1988 | 165/133 |
| JP | 89-5484 | | 5/1989 | |
| JP | 02-44103 | * | 2/1990 | 165/133 |
| JP | 2-84259 | | 3/1990 | |
| JP | 2-220768 | | 9/1990 | |
| JP | 4-332354 | | 11/1992 | |
| JP | 6-42892 | | 2/1994 | |
| JP | 6-323779 | | 11/1994 | |
| JP | 09-75832 | * | 3/1997 | 165/133 |

* cited by examiner

*Primary Examiner*—Henry Bennett
*Assistant Examiner*—Terrell McKinnon
(74) *Attorney, Agent, or Firm*—Oblon, Spivak, McClelland, Maier & Neustadt, P.C.

(57) ABSTRACT

A pipeline device which includes a metal pipe to be disposed on or connected to an appliance in a state wherein an outer periphery of the metal pipe is exposed to air or in contact with moisture or a corrosive gas, in which a refrigerant of a temperature lower than the temperature of the outside flows, and a corrosionproof coating containing a powdery material of a metal or a metal salt, coated on the outer periphery of the metal pipe.

23 Claims, 4 Drawing Sheets

PIPELINE DEVICE AND METHOD FOR ITS PRODUCTION, AND HEAT EXCHANGER

BACKGROUND OF THE INVENTION

1. Field of the Invention

The present invention relates to corrosion protection of an appliance constituted by metallic pipes and a pipeline device as a part thereof, more particularly, a technology for preventing corrosion caused by condensation at exposed metal pipe parts of a heat exchanger or the like.

2. Discussion of Background

In a pipeline device constituting a main part of a cooling apparatus, metal pipes in which a refrigerant at a temperature different from that of the external air flows are used. For example, in the production of a heat exchanger used for a refrigerator, an air conditioner or the like, a pipeline structure of continuous metal pipes is prepared by skewering metal pipes into fins of aluminium thin sheets laminated or arranged at optional intervals as flow paths of a fluid such as air, fixing the metal pipes, and connecting bends of U-shaped metal pipes to both ends of the metal pipes. By permitting a refrigerant to flow in a plurality of metal pipes disposed in such a continuous pipeline structure passing through both ends of the laminated fins, the heat of the refrigerant can be transmitted through the metal pipes to obtain a desired temperature. Accordingly, by permitting the external air to flow between the fins to conduct temperature change, this device shows a heat-exchanging function for cooling or heating.

In a case of metal pipes through which a medium of a temperature higher than room temperature flows, the surface of the metal pipes is chemically stable, since the dried state is maintained and only a gaseous state fluid flows. However, in a case where a medium of a temperature lower than room temperature flows through the metal pipes, if the temperature of the flowing gas (for example, air as atmosphere) is lower than the dew point, condensation at the metal pipe surface makes the surface active, and when the atmosphere contains an acid or a base capable of corroding the metal, the condensed water accelerates the corrosion (pitting corrosion) at the exposed portion, by which leakage of the medium flowing through the metal pipes may sometimes be caused.

As a method for preventing such a problem, a method has been employed wherein a metallic foil having a sacrificial corrosion effect is used for covering. For example, in an aluminium evaporator of a cooler unit for air conditioning introduced in JP-UM-A-60-170684, for the purpose of preventing the outer surface corrosion of a flattened aluminium tube of the evaporator, a method is proposed wherein a sacrificial corrosive material formed by a metallic foil of e.g. zinc or tin, is pressed to the exposed portion of the metal pipe by use of a metallic foil-attaching member, and fixed thereto.

By this method, even if water penetrates into the portion to which the metallic foil is attached, galvanic corrosion is caused at this portion and the metallic foil having an electric potential lower than that of the flattened aluminium tube is selectively corroded, whereby the corrosion of the flattened aluminium tube can be prevented.

Hereinbelow, the above prior art will be described in detail with reference to the drawings. FIGS. 4 to 9 are explanatory drawings showing the corrosion protection method of the exposed portion of the metal pipe disposed in conventional heat exchangers. FIG. 4 is a cross-sectional view illustrating an example of corrosion protection of a side face of a flattened aluminium tube of a cooler unit for air conditioning. FIG. 5 is an enlarged view of a main part of FIG. 4. FIG. 6 is a perspective view of a metallic foil 11 as shown in FIG. 5.

In FIG. 4, for the purpose of preventing the corrosion of the outer surface of the flattened aluminium tube, a sacrificial corrosion material is formed by press molding a metallic foil of e.g. zinc or tin against the outer surface portion of the flattened aluminium tube by use of a metallic foil-attaching member. FIG. 4 is a cross-sectional view illustrating an example of corrosion protection at the side portion of the flattened aluminium tube. FIG. 5 is an enlarged view of a main part of FIG. 4. Here, as the material for the tube 4, an aluminium alloy of JIS (Japanese Industrial Standard) A1050, A3003 or the like, is used, and as the material for a fin 5, an aluminium alloy having an electric potential lower than that of the material for the tube 4, for example, JIS A7072 is used, by which the fin is constructed so that it undergoes sacrificial corrosion.

In the figures, 1 is an evaporator, 2 is a case, 3 is a heat insulating material, 4 is a flattened tube, 4*a* and 4*b* are bent portions, 5 is a corrugate fin, 8 and 9 are pipes, 11 is a metallic foil as a part of a corrosion proof member, C is an outer surface which is in contact with the heat insulating material 3, and D is a smooth metal surface. The process of operation for preparing the above structure will be described below. Firstly, 11 is a metallic foil interposed between the heat insulating material 3 and the outer surface of the lower bent portion 4*b* of the flattened tube 4, an outlet pipe of an expansion valve or the pipe 8 or 9. In this example, as the metallic foil, a foil integrally formed by pressing as shown in FIG. 7(*a*) or FIG. 7(*b*) is used. The metallic foil 11 may be made of the same material as the fin 5. Otherwise, any material may be used so long as it shows a corrosion effect by the sacrificial corrosion of the tube 4 of e.g. zinc. The thickness of the metallic foil 11 is preferably from 40 to 200 $\mu$m. The metallic foil 11 is formed into a shape fitting on the lower bent portion 4*b* of the flattened tube 4 and the pipes 8 and 9, and interposed between the evaporator 1 and the heat insulating material 3 for assembling.

According to the above measures and structure, since the metallic foil 11 as the corrosion proof member is pressed and bonded to the outer surface C of the lower bent portion 4*b* of the flattened tube 4, the corrosion protection effect by the sacrificial corrosion of the metallic foil 11 acts directly on the outer surface C, whereby the corrosion of the outer surface C can effectively be prevented. Further, the same corrosion protection effect can be given for other portions such as pipes 8 and 9.

As examples of similar techniques, certain measures have been introduced wherein a metal having a sacrificial corrosion function is applied to the back surface of the metallic foil 11 and this foil is fixed on the case 2. Such measures may include fixing of the metallic foil on the heat insulating material 3 by use of an adhesive as illustrated in FIG. 8, or uniform coating of metal powder on the heat insulating material 3 by use of a resin having an adhesion function as illustrated in FIG. 9. In both cases, the metallic foil 11 for the sacrificial corrosion is bonded to the case 2 in such a state that the foil 11 is pressed to the outer surface C of the lower bent portion 4*b* of the flattened tube 4, by which the outer surface C is protected from corrosion by the corrosion proof effect obtainable by the sacrificial corrosion of the metallic foil 11.

However, for the method of bonding the metallic foil of e.g. zinc or tin in the above measures, it is important to fit the metallic foil well on the case 2 as the corrosion proof member at the time of production. If the metallic foil is provided in an overly stretched state to the case having concaves for closely bonding it to pipes for which corrosion protection is to be given, there are drawbacks that the metallic foil tends to be torn when the corrosion proof member having them integrated is closely bonded to the pipes or used under the condition that stress is applied by vibration or temperature change.

Further, if the metallic foil is provided with looseness, folds and consequently wrinkles will be formed. Accordingly, as in the above case where the metallic foil is torn, the metallic foil having the sacrificial corrosion protection is not bonded in some parts of the flattened tube surface. As a result, not only the corrosion proof effect by the sacrificial corrosion can not be obtained, but also stagnation of condensed water tends to occur, whereby corrosion (pitting corrosion) will be formed at that portion on the flattened tube surface, leading to worse result which spoils the reliability on use, for example, leakage of a refrigerant by the formation of corrosion holes.

Further, substantial skill is required to conduct operations without forming the parts to which no metallic foil is bonded on the flattened tube surface, in order to remove the above problems in the operation. Accordingly, there is a drawback that it is difficult to accomplish simplification of operations including automating or the like in the production of the evaporator.

SUMMARY OF THE INVENTION

Under such circumstances, the present invention has been accomplished. It is an object of the present invention to provide a pipeline device having a means for easily and efficiently accomplishing corrosion protection, having a high reliability and a method for its production, by which metal pipes of e.g. copper in a pipeline device such as a heat exchanger used under a high humidity atmosphere, are protected from pitting corrosion and ants' nest-like corrosion due to condensation or attachment of a corrosive gas.

The first aspect of the present invention relates to a pipeline device which comprises a metal pipe to be disposed on or connected to an appliance in a state such that an outer periphery of the metal pipe is exposed to air or in contact with moisture or a corrosive gas, in which a refrigerant of a temperature lower than the temperature of the outside flows, and a corrosionproof coating containing a powdery material of a metal or a metal salt, is coated on the outer periphery of the metal pipe.

The second aspect of the present invention is that the powdery material of a metal or a metal salt has a polarization potential lower than the polarization potential of the metal pipe.

The third aspect of the present invention is that the corrosionproof coating is at least one selected from the group consisting of a mixture of a water-soluble coating and zinc phosphate, a mixture of a water-insoluble coating and zinc, and a mixture of a thermoplastic resin and zinc.

The fourth aspect of the present invention is that the pipeline device further comprises fins for transmitting the heat in the metal pipe to an outside of the metal pipe, the fins being provided in contact with the outer periphery of the metal pipe via the corrosionproof coating.

The fifth aspect of the present invention relates to a method for producing a pipeline device, which comprises a step of forming into a desired shape a metal pipe to be disposed in a state that an outer periphery of the metal pipe is exposed to air or in easily contact with moisture or a corrosive gas; and one of the following steps (a) and (b):

Step (a): coating a corrosionproof coating containing a powdery material of a metal or a metal salt on the outer periphery of the metal pipe; and bringing fins for transmitting the heat in the metal pipe to an outside of the metal pipe into fixedly contact with the outer periphery of the metal pipe;

Step (b): fitting fins for transmitting the heat in the metal pipe to an outside portion of the metal pipe, to the outer periphery of the metal pipe; and coating a corrosionproof coating containing a powdery material of a metal or a metal salt on the outer periphery of the metal pipe, wherein the powdery material of a metal or a metal salt has a polarization potential lower than the polarization potential of the metal pipe.

The sixth aspect of the present invention relates to the method wherein the corrosionproof coating is a mixture of a water-soluble coating and zinc phosphate, or a mixture of a water-insoluble coating and zinc.

The seventh aspect of the present invention relates to the method wherein the corrosionproof coating is coated on the outer periphery of the metal pipe by immersing the metal pipe in a thermoplastic organic resin fluid in a heated and molten state or in a powdery state.

The eighth aspect of the present invention relates to a heat exchanger which comprises a metal pipe for exchanging heat with a fluid flowing in the metal pipe, and fins which are in fixedly contact with an outer periphery of the metal pipe, for exchanging the heat between the metal pipe and air outside the metal pipe, wherein at least a part of the outer periphery of the metal pipe is coated with a corrosionproof coating containing a powdery material of a metal or a metal salt, and the powdery material of a metal or a metal salt has a polarization potential lower than the polarization potential of a material constituting the metal pipe.

The ninth aspect of the present invention relates to the heat exchanger wherein the corrosionproof coating is at least one selected from the group consisting of a mixture of a water-soluble coating and zinc phosphate, a mixture of a water-insoluble coating and zinc, and a mixture of a thermoplastic resin and zinc.

The tenth aspect of the present invention relates to the heat exchanger wherein the fins are fitted to the outer periphery of the metal pipe with the corrosionproof coating interposed.

DESCRIPTION OF THE PREFERRED EMBODIMENTS

Embodiment 1

Figure 1:
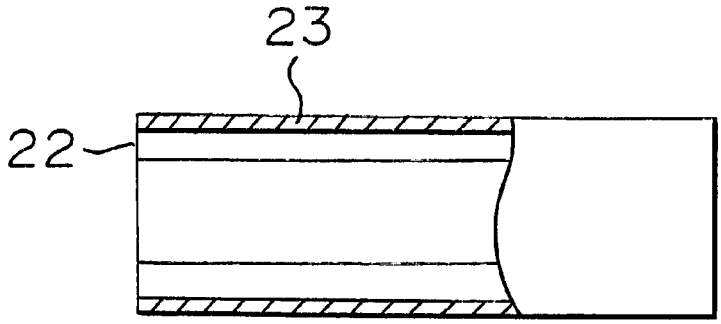
FIG. 1 is a partially cutaway side view of a pipeline device of the present invention.
Figure 2:
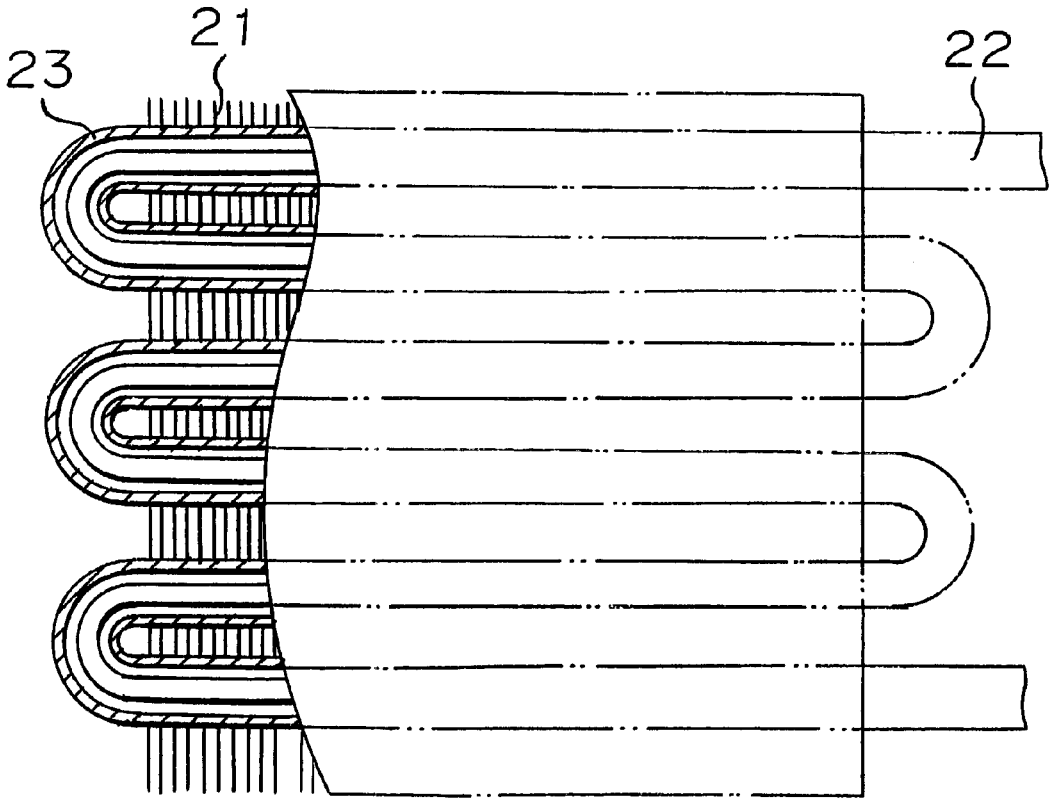
FIG. 2 is a partially cutaway side view of a fin-and-tube type heat exchanger of the present invention.
Figure 3:
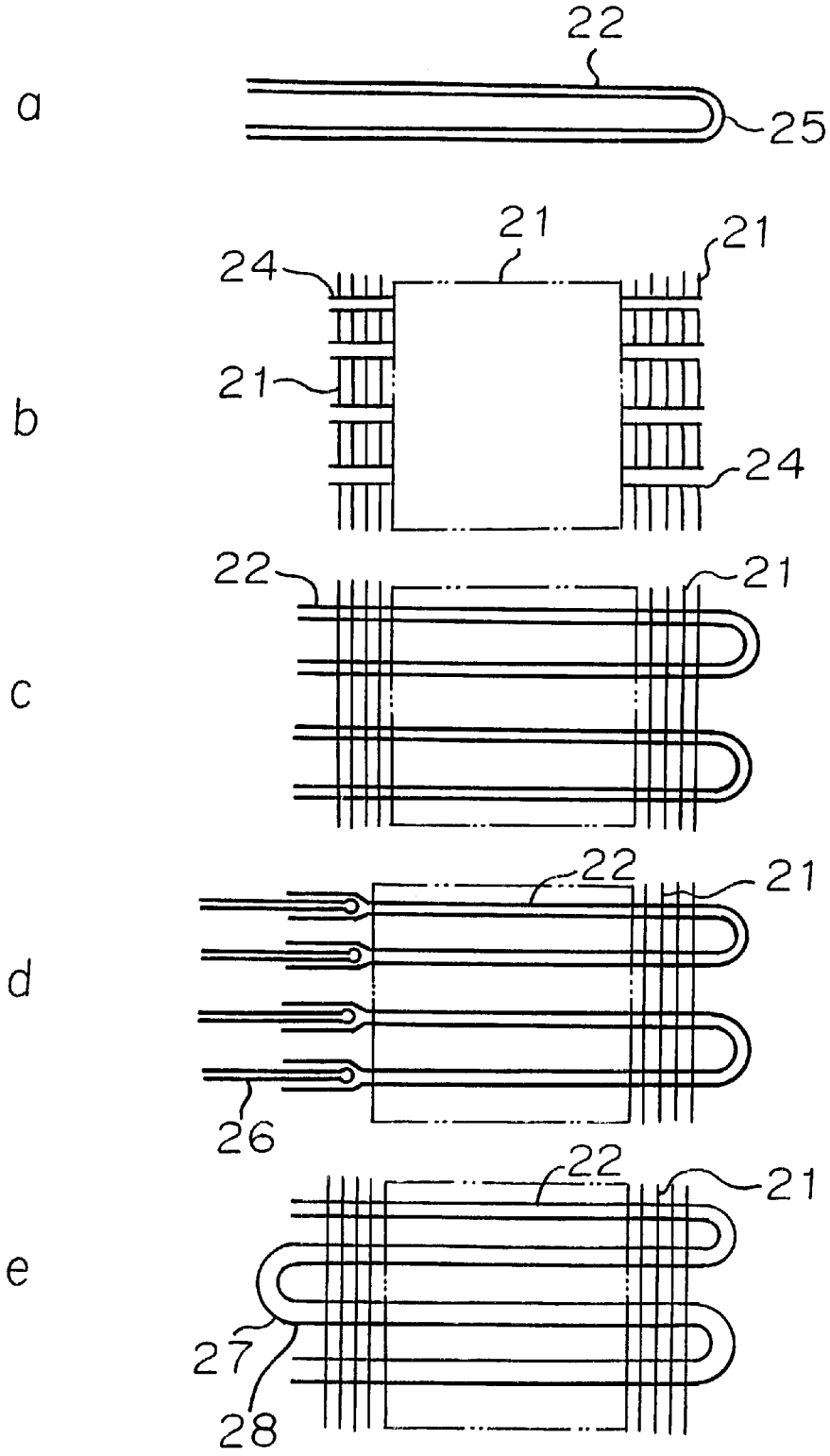
FIGS. 3(*a*) to 3(*e*) are views showing the steps of producing a fin-and-tube type heat exchanger.
Figure 4:
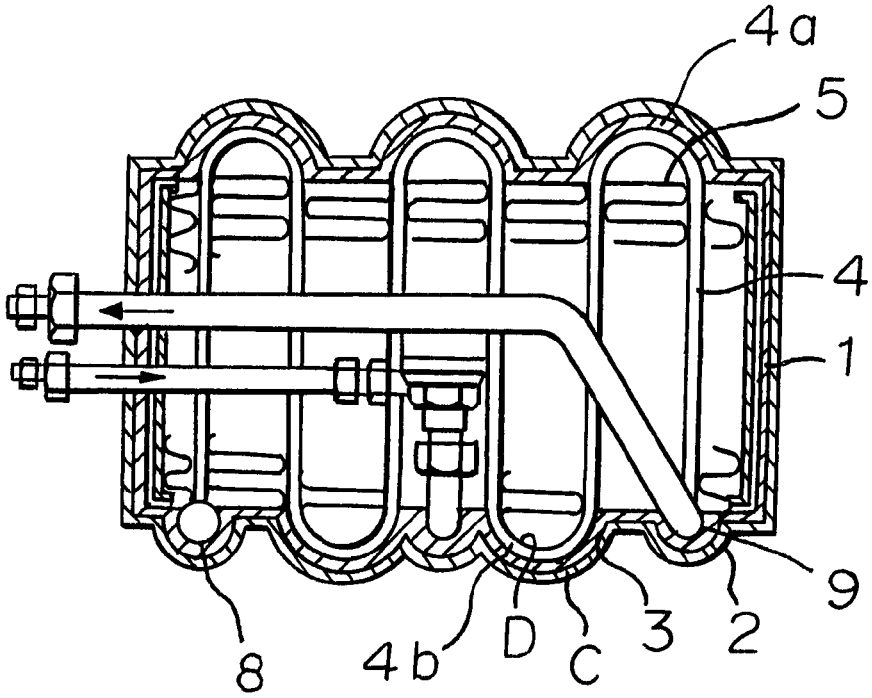
FIG. 4 is a cross-sectional view showing an example of a corrosionproof structure of a side face of a flattened aluminum tube of a conventional air-conditioning cooler unit.
Figure 5:
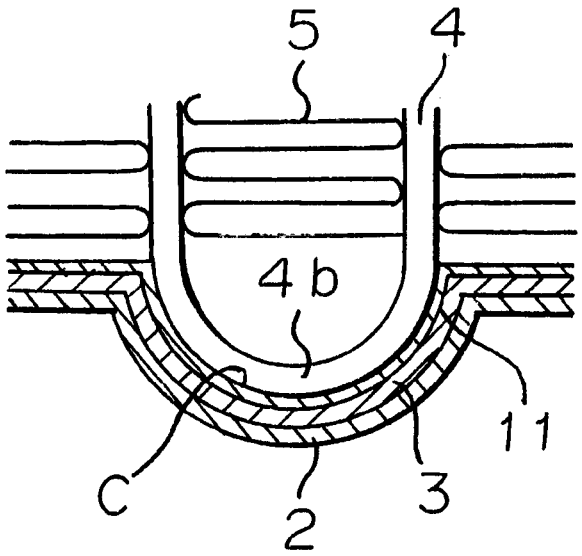
FIG. 5 is an enlarged view of a main part of FIG. 4.
Figure 6:
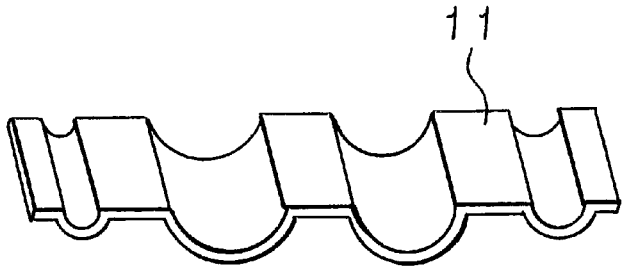
FIG. 6 is a perspective view of a metallic foil used in FIG. 5.
Figure 7:
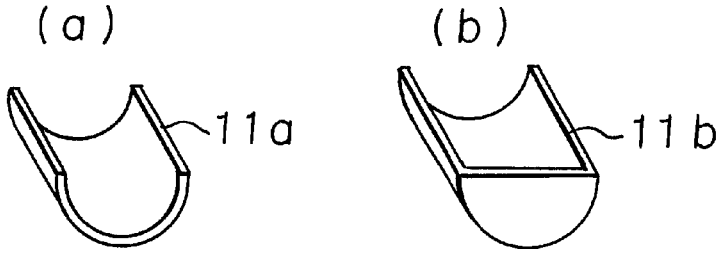
FIG. 7 is a perspective view of the metallic foil as the member indicated by the numeral 11 in FIG. 4.
Figure 8:
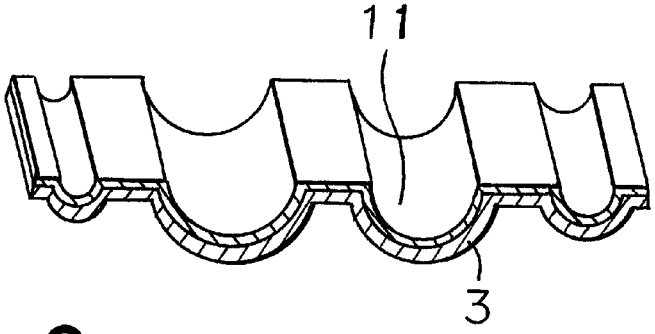
FIG. 8 is a perspective view showing the state wherein a metallic foil is preliminarily adhered with an adhesive to the surface of the heat insulating material in FIG. 4 (i.e. the surface of the evaporator side).

Hereinafter, a pipeline device as an example of the present invention will be described with reference to FIGS. 1 and 2. FIG. 1 is a partially cutaway side view of the pipeline device of the present invention. FIG. 2 is a partially cutaway side view of a fin-and-tube type heat exchanger used for an air conditioner as the pipeline device of the present invention. Here, the numeral 21 is a fin plate made of aluminum. The aluminum fins are provided with adequate spaces so that the air supplied by a fan or the like can pass through the space between the adjacent fins. Further, the numeral 22 is a copper pipe for a refrigerant pipeline as the metal pipe which abuts on the aluminum fin 21 and through which a refrigerant of a temperature lower than the atmospheric temperature flows. The numeral 23 is a corrosionproof film. For the purpose of preventing the corrosion due to condensation caused when the air is brought into contact with the aluminum fin 21 and the copper pipe 22 for a refrigerant pipeline, as shown in FIG. 1, on the surface of the copper pipe 22 for a refrigerant pipeline, a corrosionproof film 23 is formed by uniformly coating a corrosionproof coating on the entire outer surface of the copper pipe.

FIG. 2 is a partially cutaway side view of a fin-and-tube type heat exchanger used for an air conditioner as the pipeline device of the present invention. The numeral 20 is a heat exchanger. The numeral 21 is a fin plate made of aluminum as in FIG. 1. The aluminum fins are provided with adequate spaces so that the air supplied by a fan or the like can pass through the space between the adjacent fins. Further, the numeral 22 is a copper pipe for a refrigerant pipeline as the metal pipe which abuts on the aluminum fin 21 and through which a refrigerant of a temperature lower than the atmospheric temperature flows. Accordingly, for the purpose of preventing the corrosion due to condensation caused when the air is brought into contact with the aluminum fin 21 and the copper pipe 22 for a refrigerant pipeline, as shown in FIG. 1, on the surface of the copper pipe 22 for a refrigerant pipeline, a corrosionproof film 23 is formed by uniformly coating a corrosionproof coating on the entire outer surface of the copper pipe.

The corrosionproof film 23 used in this embodiment, is obtained by uniformly coating a corrosionproof coating which is capable of forming a corrosionproof film having a polarization potential lower than that of copper as the material of the copper pipe for a refrigerant pipeline, or the like, on the entire surface of the copper pipe.

The corrosionproof coating used in the embodiment is one obtained by preliminarily mixing either one of zinc phosphate powder or zinc powder uniformly. Examples of the coating are shown in Table 1.

Table 1 shows materials to be coated for the formation of the corrosionproof film uniformly on the entire outer surface of the copper pipe for a refrigerant pipeline, and methods for coating the materials. Each of the corrosionproof coatings is adjusted so that the polarization potential of the coated film would be certainly lower than that of copper as the material of the metal pipe. Zinc powder in Corrosionproof coatings-1 and 2 and zinc phosphate powder in Corrosionproof coating-3, are uniformly incorporated into an alkylmelamine resin as the resin component. Using Corrosionproof coating-1, 2 or 3, the entire outer surface of a copper pipe was coated in accordance with the coating method 1, 2 or 3. The coated pipes were used for comparison tests with Comparative Examples as described below.

TABLE 1

| Composition | Corrosion-proof coating-1 | Corrosion-proof coating-2 | Corrosion-proof coating-3 |
|---|---|---|---|
| Coloring agent | Carbon: 10 wt % | Carbon: 10 wt % | Carbon: 10 wt % |
| Resin component | Water-insoluble alkylmelamine resin: 50 wt % | Water-soluble alkylmelamine resin: 50 wt % | Water-soluble alkylmelamine resin: 50 wt % |
| Solvent | Xylene: 20 wt % | Water: 20 wt % | Water: 20 wt % |
| Sacrificial corrosion metal powder | Zinc: 20 wt % | Zinc: 20 wt % | Zinc phosphate: 20 wt % |
| Coating method 1 | Spray coating | Spray coating | Spray coating |
| Coating method 2 | Dip coating | Dip coating | Dip coating |
| Coating method 3 | Flow coating | Flow coating | Flow coating |

Next, the coating method for forming the corrosionproof film will be described. For the entire outer surface of the exposed copper pipe of both ends of the fin-and-tube type heat exchanger, which is apt to have condensation in the state wherein it is exposed to air or is easily in contact with air, a spray coating method in which spray coating is used, a dip coating method wherein it is dipped in a coating fluid, or a flow method wherein a coating is flowed on the part to be coated, are employed.

In the above-noted coating methods, as indicated in Table 1, any one of water-insoluble or water-soluble corrosion-proof coatings obtained by uniformly mixing zinc powder or zinc phosphate powder to an alkylmelamine resin as a resin component, may be used.

Further, as another method, into a powdery fluid vessel filled with a thermoplastic resin (polyolefin resin) powder of the present invention, an end portion of the fin-and-tube type heat exchanger heated to the desired temperature higher than the melting point of the thermoplastic resin to melt the thermoplastic resin, followed by coating of the corrosion proof film.

Otherwise, the corrosion proof film may be formed by coating a resin by a method wherein a resin in a molten state is prepared by heating a thermoplastic resin (polyolefin resin) to a temperature higher than the melting point of the resin, and an end portion of the fin-and-tube type heat exchanger is dipped therein and drawn up to form a coating film.

Hereinafter, a method for producing a pipeline device of the present invention will be described. This method relates to corrosion protection of an appliance constituted by metallic pipelines or a pipeline device as a part thereof. In this method, in order to prevent corrosion of copper pipe portions of a fin-and-tube type heat exchanger constituted by aluminium fins and a copper pipe, a coating having a sacrificial corrosion effect is coated on exposed metal pipe portions to prevent the corrosion of the copper pipes (for example, pitting corrosion and ants' nest-like corrosion).

A method for producing a heat exchanger of the present invention will be described in detail with reference to a flow chart of FIG. 3*a* to 3*e* which shows a method for producing a fin-and-tube type heat exchanger. The numeral 25 is a hairpin portion of a metal pipe 22, 24 is a burring hole formed in a fin, 26 is a tube-expanding rod, 27 is a U-shaped bend and 28 is a brazed portion.

Firstly, a hairpin-type copper pipe (hereinafter referred to as a hairpin tube) having a U-shaped bend hairpin portion 25 formed by a draw bending method as shown in FIG. 3*a* (a method wherein a core bar code as a mandrel is inserted from one end of a pipe and, in such a state, the pipe is bent along a bending mold). The hairpin tube is used for a copper pipe 22 for a refrigeration pipeline. Over the entire outer surface of the hairpin tube 22, Corrosionproof coating-1, -2 or -3 indicated in Table 1 is coated in a thickness of from 10 to 20 μm. Details of the coating method will be described below.

Aluminium bars having a thickness of about 0.1 mm are subjected to press working (after the formation of pierce holes by press working, an ironing rod is inserted into the pierce holes to form burring holes 24) to form burring holes 24 having an inner diameter larger than the diameter of the hairpin tube 22 by about 10 μm, and the aluminium bars are arranged at a constant intervals to form aluminium fins 21 (FIG. 3*b*), and then the hairpin tube is inserted through the holes from one side (FIG. 3*c*). Then, from the end portions of the hairpin tube 22 inserted through the burring holes 24 of the aluminium fins 21, a tube-expanding rod 26 having a steel ball having an outer diameter larger than the inner diameter of the hairpin tube pipe 22 by about 20 μm is inserted to expand the outer diameter of the hairpin tube, by which the hairpin tube is closely bonded to the burring holes provided in the aluminium fins (FIG. 3*d*). Into the end portions of the hairpin tube, a U-shaped bend obtained by bending a copper pipe into a U-shaped form, is inserted, and the inserted portions are brazed to form brazed portions 28, whereby a circuit in which a refrigerant flows through the hairpin tube 22 and the U-bend 27 is prepared (FIG. 3*e*).

Since no corrosionproof film 23 is formed on the U-bend 27, after the brazing, at the U-bend side of the fin-and-tube type heat exchanger, a corrosionproof film is formed by coating in a thickness of from about 10 to 20 μm, in accordance with a spray coating method using an airless spray for Corrosionproof coating-1 indicated in Table 1, a dip coating method for Corrosionproof coating-2 and a flow coating method for Corrosionproof coating-3. Here, on the surface of the copper pipe for the refrigerant pipeline, a coating film is formed by using a coating obtained by uniformly mixing zinc powder or zinc phosphate powder, whereby the polarization potential of the surface is lower than that of copper.

In the foregoing, the coating film 23 is coated over the entire parts of the metal pipe 22. However, the coating may be made on a part of the heat exchanger, for example, only the end portion thereof. This is because that the outer surface of the tube disposed in the burring portions of the fins is hardly exposed to a corrosive gas or the like, and the exposed portions are mostly the end portions of the tube. Likewise, for the pipelines through which the refrigerant flows, the coating film 23 may be coated on the portions to which the corrosive gas and condensation are concentrated, for example, exposed portions other than the portions surrounded by a cover to which the air hardly penetrates. The coating conditions and coating method of respective corrosionproof coatings indicated in Table 1 will be described below. As explained in relation to FIG. 3, after coating the tube, the tube is expanded and pressed to and fixed on the fins. Accordingly, firstly, it is important to coat it uniformly. Secondly, the formation of cracks and holes during the expansion of the tube should desirably be low.

The spray coating is made by using an air spray coating apparatus wherein the coating indicated in Table 1 is spray coated on the hairpin tube 22 and the U-bend 27 side of the fin-and-tube type heat exchanger. The coating conditions are indicated below.

Viscosity of a coating: 60 sec/Iwata cup viscometer

Spray pressure: 0.5 MP

Setting time: 1 min

Baking and drying conditions: 150° C.×10 min

The opening portions of the hairpin tube are covered with rubber caps before coating so that the coating would not enter the inside of the pipe during the coating of the hairpin tube 22. At the time of spray coating of the U-bend side, the aluminium fin portions are covered by masking so that no coating would attach to the aluminium fins 21.

Further, the dip coating is conducted by the following measures. Namely, a coating is charged in a stainless steel bath having a capacity of about 20 l, and the coating bath is stirred by use of a vane-rotating type stirrer and, at the same time, the temperature of the coating is adjusted to 25° C. by use of an electric immersion heater placed in the coating bath to prepare a dip coating bath. Then, the U-bend side of the fin-and-tube type heat exchanger 20 is immersed therein to conduct the dip coating with the coating indicated in Table 1. The coating conditions are indicated below.

Viscosity of a coating: 45 sec/Iwata cup viscometer

In order to adjust the thickness of the coating film to from 10 to 20 μm, the viscosity of the coating is fixed to 45 sec/Iwata cup viscometer.

Temperature of a coating bath: 25° C.

Immersing time: 30 sec

Draining and setting time: 5 min

Baking and drying condition: 150° C.×10 min

At the time of coating the hairpin tube 22, the opening portions of the hairpin tube are covered with rubber caps before coating so that the coating would not enter the inside.

Further, in the flow coating, a coating is charged in a stainless steel bath having a capacity of about 20 l, equipped with a valve faucet for flow rate adjustment having a rubber hose with an inner diameter of 8 mm, a thickness of 1 mm and a length of 1.5 m installed at the forward end of the faucet at the lowermost portion of the bath. The coating bath is stirred with a vane-rotating type stirrer, and at the same time, the temperature of the coating is adjusted to 25° C. with an electric immersion heater placed in the coating bath to conduct flow coating. The flow coating bath is placed at a position higher than the position of the object to be coated, and the valve for flow rate adjustment is opened and adjusted so that the flowing rate of the coating from the forward end of the rubber hose would be about 5 l/min, and then the coating indicated in Table 1 is flowed on the U-bend side of the fin-and-tube type heat exchanger 20. The coating conditions are indicated below.

Viscosity of a coating: 45 sec/Iwata cup viscometer

Temperature of a coating bath: 25° C.

Flow coating

Diameter of faucet: 8 mm, flow rate of the coating: 5 l/min, and flow coating is conducted one time Draining and setting time: 1 min Baking and drying condition: 150° C.×10 min At the time of coating the hairpin tube, the opening portions of the hairpin tube are covered with rubber caps before coating so that the coating would not enter the inside.

Embodiment 2

To a fin-and-tube type heat exchanger 20 having its hairpin tube 22 subjected to corrosionproof treatment in accordance with Embodiment 1, the following corrosionproof treatment is conducted on its U-bend side 27.

Exposed copper portion is immersed in a polyolefin resin bath melted by heating to 150° C., and drawn up, and left to cool naturally to form an organic resin coating having a thickness of about 2 to 3 mm on the surface of the copper pipe. The polyolefin resin bath for coating the copper pipe is prepared by mixing a polyolefin resin and polyethylene vinyl acetate at a rate of 100:25, followed by heating at 150° C. for melting it, and then mixing 10 wt % of zinc powder thereto uniformly.

Comparative Example 1

On exposed copper pipe surfaces at both ends of a fin-and-tube type heat exchanger 20, a general-purpose alkylmelamine resin coating containing no metal composition having a sacrificial corrosion effect to copper, was coated to a coating thickness of from about 10 to 20 $\mu$m by a coating method using an airless spray, a dip coating method or a flow coating method. This is referred to as Comparative Example 1.

Comparative Example 2

By a method proposed in JP-UM-A-60-170684 where a sacrificial corrosion material is pressed to an exposed portion of a metal pipe with a metallic foil-attaching member, a zinc foil having a thickness of 50 $\mu$m was pressed to and fixed on exposed copper pipe surfaces at both ends of a fin-and-tube type heat exchanger by use of a metallic foil-attaching member. This is referred to as Comparative Example 2.

The metallic foil-attaching member was prepared as described below. On an inner wall of a vessel of a size larger than the outer shell size of a U-bent portion of a hairpin tube by about 5 mm, vaseline was coated, and then an unpolymerized polyester resin liquid containing a curing agent was charged in the vessel. Then, the U-bent portion of the hairpin tube on which vaseline as a releasing agent was coated, was dipped in an intermediate part of the polyester resin liquid, and under such state, the polyester resin liquid containing the curing agent was cured by heating. Then, the polyester resin thus heated and polymerized, having the U-bent of the hairpin tube incorporated therein, was taken out of the vessel, and the U-bend of the hairpin tube and the polyester resin were cut so that the U-bend of the hairpin tube would be divided vertically into two pieces. Finally, the U-bend of the hairpin tube divided vertically into two pieces was removed, and the polyester resin portions were used as a metallic foil-attaching member to be used for pressing and fixing the zinc foil with a thickness of 50 $\mu$m to the exposed copper pipe surfaces at both ends of the fin-and-tube type heat exchanger.

Comparative Example 3

Figure 9:
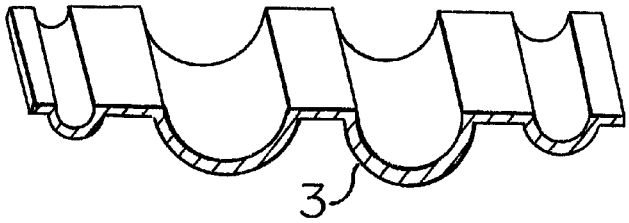
FIG. 9 is a perspective view showing the state wherein a metal powder having a sacrificial corrosion protection property mixed with an adhesive or the like is coated on the surface of the heat insulating material 3 in FIG. 4 (i.e. the surface of the evaporator side).

JP-UM-A-60-170684 proposes a method wherein the one obtainable by uniformly coating metal powder with a resin having an adhesive function, is pressed and fixed to an exposed portion of a metal pipe as indicated in FIG. 9. This is referred to as Comparative Example 3. Vaseline as a releasing agent was coated on an inner wall of a vessel with a size larger than the outer shell size of a U-bend of a hairpin tube by about 5 mm, and then an unpolymerized polyester resin liquid containing a curing agent was charged in the vessel. The U-bend of the hairpin tube coated with vaseline as a releasing agent was dipped in the intermediate portion of the polyester resin liquid and, under such state, the polyester resin liquid containing the curing agent was cured by heating. The polyester resin thus heated and polymerized having the U-bend of the hairpin tube incorporated therein, was taken out of the vessel, and the U-bend of the hairpin tube and the polyester resin were cut so that the U-bend of the hairpin tube was divided vertically into two pieces. The U-bend of the hairpin tube vertically divided into two pieces, was removed from the cut faces of the polyester resin. The polyester resin molded products were used as members for pressing and fixing a resin obtainable by uniformly mixing metal powder to a resin having an adhesive function. To the inner surface of the U-shaped groove of the member from which the U-bend of the hairpin tube was removed, the one obtained by adding about 20% of zinc powder to an uncured epoxy resin adhesive and thoroughly mixing them, was coated in a thickness of about 50 $\mu$m, and this member was pressed and fixed to an exposed copper pipe surface at both ends of a fin-and-tube type heat exchanger. Under such state, these where left to stand at room temperature for 24 hours to completely cure the epoxy resin adhesive. This is referred to as Comparative Example 3.

Comparative Example 4

A fin-and-tube type heat exchanger having both end portions (U-bend portion of hairpin tube, and U-bend portion) of which the copper pipe surface was exposed, was prepared, and this is referred to as Comparative Example 4.

In order to evaluate the corrosionproof films of the present invention and the films of the Comparative Examples, the polarization potential values to copper, of the corrosionproof films coated on the copper pipe surface, were measured. The values are indicated in Table 2.

TABLE 2

| Corrosionproof film | Polarization potential to copper (mV) (*1) |
|---|---|
| Corrosionproof coating-1 | −750 |
| Corrosionproof coating-2 | −750 |
| Corrosionproof coating-3 | −100 |
| Thermoplastic resin | −150 |
| Comparative Example 1 | 0 |
| Comparative Example 2 | −750 |
| Comparative Example 3 | −30 |
| Comparative Example 4 | 0 |

*1 Polarization potential to copper (mV): The smaller the polarization potential value is, the larger the sacrificial corrosionproof effect is.

Each of the polarization potential values of Corrosionproof coating-1, Corrosionproof coating-2, Corrosionproof coating-3, the thermoplastic resin, Comparative Example 2 and Comparative Example 3, is negative as compared with the polarization potential value of copper. Accordingly, it can be expected that every film thereof shows a sacrificial corrosionproof effect. On the contrary, it is expected that the film of Comparative Example 1 shows no sacrificial corrosionproof effect by a corrosionproof film.

Since each of corrosionproof films obtained by coating Corrosionproof coating-1, Corrosionproof coating-2 and Corrosionproof coating-3 contains a metal powder or a metal salt powder having a heat transmittance higher than the resin, the corrosionproof film formed by the coating has a higher heat transmittance as compared with a film of a coating containing no metal powder or no metal salt powder, and the fin-and-tube type heat exchangers constituted by the aluminium fins and the hairpin tubes having such a coating coated on the surface, undergo no deterioration of the heat transmitting properties between the hairpin tubes and the aluminium fins, whereby improvements of the corrosion-proof properties can be expected without losing the performance as the fin-and-tube type heat exchangers.

Corrosion Acceleration Test

As a result of researches on corrosion-accelerating substances of a copper pipe in an atmospheric circumstance under which an air conditioner having a fin-and-tube type heat exchanger disposed is practically used, organic acid components such as formic acid as typical corrosion-accelerating substances floating in the air, were detected. It was confirmed that in the case where a medium of a temperature lower than the atmospheric temperature under practical operation circumstance passed through the copper pipe of the fin-and-tube type heat exchanger, when the air was cooled below the dew point, condensed water under active condition containing the formic acid or the like floating in the air, attached to the copper pipe surface and accelerated the corrosion (pitting corrosion) of the copper pipe, leading to the leakage of the medium passing through the copper pipe. Accordingly, the evaluation of the corrosionproof properties of the fin-and-tube type heat exchanger using copper pipes to which corrosion protection was applied, was made by comparative evaluation of the corrosionproof properties of the copper pipes against condensed water containing formic acid.

Evaluations of the corrosionproof properties of the fin-and-tube type heat exchanger using copper pipes of which the surfaces were subjected to corrosion protection according to the present invention and Comparative Examples 1 to 4, were conducted by a corrosion-accelerating test. The evaluation of the corrosionproof properties was conducted as follows. 1 l of a 1 wt % formic acid aqueous solution was charged in a desiccator with a capacity of 30 l, and a fin-and-tube type heat exchanger to be tested was placed in a space above the aqueous formic acid solution so that it would not be in contact with the aqueous formic acid solution. A lid was put on the desiccator, and a heat cycle test with 1 cycle at 20° C. for 12 hours and 40° C. for 12 hours was repeated 30 cycles. Here, as a result of 30 cycles of the heat cycle test on the copper pipe having no corrosionproof film under the test conditions, it was confirmed that the maximum depth of the pitting corrosion formed on the copper pipe surface reached 300 μm which is the same as the thickness of the pipe. Accordingly, 30 cycles operation under such test conditions was used as the evaluation test condition of the corrosionproof properties. After completion of 30 cycles, the fin-and-tube type heat exchanger to be tested was taken out of the desiccator, the copper pipe surface was inspected, and when the presence of corrosion formed on the copper pipe surface was recognized, such a portion was cut and the cross-section thereof was inspected by a microscope to measure the depth of a hole formed by the corrosion.

Test Results

The results of the evaluation are shown in Table 3.

TABLE 3

| Coating method | Corrosion-proof coating-1 | Corrosion-proof coating-2 | Corrosion-proof coating-3 | Thermo-plastic resin | Comp. Ex. 1 | Comp. Ex. 2 | Comp. Ex. 3 | Comp. Ex. 4 |
|---|---|---|---|---|---|---|---|---|
| Spray coating | No corrosion 0 | No corrosion 0 | No corrosion 0 | — | Corroded 150 | — | — | — |
| Dip coating | No corrosion 0 | No corrosion 0 | No corrosion 0 | — | Corroded 155 | — | — | — |
| Flow coating | No corrosion 0 | No corrosion 0 | No corrosion 0 | — | Corroded 148 | — | — | — |
| Dipping and drawing up | — | — | — | No corrosion | — | — | — | — |
| Fixed by press-ing | — | — | — | — | — | Corroded 200 | Corroded 150 | — |
| No coating | — | — | — | — | — | — | — | Corroded 280 |

The value indicated in the Table is the depth of the pitting corrosion (μm).

The results of studies on the evaluation of the corrosion-proof properties will be described below, with respect to the samples of the present invention (nine types formed by the spray coating, dip coating or flow coating using Corrosion-proof coatings-1 to 3, and a corrosionproof film obtained by the coating method of dipping and drawing up, using the thermoplastic resin).

The above results are explained below in summary.

Corrosionproof coatings-1 to 3 show no formation of corrosion in any coated product of the spray coating, dip coating and flow coating. In usual, in the case of the coating of a general-purpose resin coating and the coating thickness of from 10 to 20 μm, when defective portions such as pin holes are formed in the coating film and condensed water or the like attach to the pin hole portions, the defective portions such as pin holes will undergo anodic polarization against sound portions of the coating film as a cathode and corrosion will be concentrated on the anodic polarized portions. However, the reason why no corrosion was seen at the portions on which Corrosionproof coating-1, Corrosion-proof coating-2 and Corrosionproof coating-3 were coated, was as follows. Since the polarization potential of the coating film was lowered by the presence of zinc powder or zinc phosphate powder uniformly mixed to the coating, even if defective portions such as pin holes were present in the coating film, such defective portions did not undergo anodic polarization.

The spray coating was conducted by spray coating method by use of air. However, if the region to be coated is small or the spray coating is conducted using a high viscosity corrosionproof coating having the solvent amount decreased, it is more preferred to employ an airless spray coating method wherein a coating compressed to about 1 MP (Mega Pascal) is directly sprayed from a nozzle having an inner diameter of about 200 μm. By such a method, uniform coating can be made.

No corrosion was formed on the products coated with the polyolefin type thermoplastic resin for the following three reasons. Firstly, since the resin coating film was as thick as from 2 to 3 mm, defective portions such as pin holes were not formed in the coating film. Further, an organic resin coating film having a thickness of from about 2 to 3 mm was formed on the copper pipe surface by dipping the copper pipe in a resin bath melted by heating at 150° C., drawing it up and leaving it to cool naturally, the adhesion between the copper pipe surface and the organic resin constituting the coating film was excellent and no water impregnated through the interface, whereby no corrosion was formed. Furthermore, since 10 wt % of zinc powder was uniformly mixed to the organic resin bath for coating so as to form an organic resin coating film having a polarization potential lower than that of copper, even if defects such as scratches were present on the organic resin coating film, such defective portions did not undergo anodic polarization and no corrosion was formed.

In Comparative Example 1, pitting corrosion having a depth of about 150 μm was formed on the copper pipe surface below the coating film. The coating film at which the pitting corrosion occurred showed bulges of the coating film and the pitting corrosion was formed on the copper pipe surface below the bulges of the coating film for the following reason. On the surface of defective portions such as pin holes present on the coating film of the general-purpose alkylmelamine resin coating containing no metal components, condensed water containing formic acid attached to the surface, and the copper pipe surfaces at the pin hole portions underwent anodic polarization, resulting in concentrated corrosion.

In Comparative Example 2, penetration of water was observed at the interface between the copper pipe surface and the adhesive layer, and the formation of pitting corrosion having a depth of above 100 μm was observed on the copper pipe surfaces at such portions. Further, pitting corrosion having a depth of about 200 μm was formed on some portions of the copper pipe surface at which the zinc foil was torn when it was pressed against the copper pipe, for the following reason. On the portions at which the zinc foil was torn, a space was formed wherein the zinc foil having a sacrificial corrosion effect was not present between the copper pipe surface and the metallic foil-attaching member and water penetrated into the space, resulting in the formation of corrosion at gaps.

In Comparative Example 3, moisture penetrated into the interface between the copper pipe surface and the adhesive layer, and the corrosion formed on the entire surface of the copper pipe at such portion, and at the worst corroded portion, pitting corrosion having a depth of about 150 μm was formed. On the other hand, corrosion formed on the product coated with the thermoplastic resin for the following two reasons. Firstly, after preparation of an adhesive layer surface as a contact surface with copper at the surface of the member (the face in contact with the copper pipe surface), when this member was pressed to the copper pipe, bubbles were formed at the joint interface between the copper pipe surface and the adhesive layer surface, and some portions were formed wherein the copper pipe surface was not continuously in contact with the adhesive layer. This is because that it was impossible to form an adhesive layer into a concave configuration corresponding to the bending convex configuration of the copper pipe surface. At the joint interface between the copper pipe surface and the adhesive layer surface, moisture penetrated into the portions at which the copper pipe surface was not continuously in contact with the adhesive layer, by which corrosion was formed in the gap on the copper pipe surface. Next, in a step wherein an adhesive having metal powder preliminary blended was coated on a member for pressing and fixing an adhesive layer to the copper pipe surface so as to form an adhesive layer on the surface of the member at the contact face with copper, a skin layer constituted by an adhesive component alone was formed on the adhesive layer surface (a face in contact with the copper pipe surface), and the adhesive layer was in contact with the copper pipe surface with the skin layer interposed, whereby the skin layer functioned as an electric insulation film and no sacrificial corrosion effect of the blended zinc powder was obtained.

In Comparative Example 4, corrosion formed on the entire surface of the exposed portions of the copper pipe, and the depth of the pitting corrosion at the most corroded portion was 280 μm.

As a result of observation of the storage stability of the corrosionproof coating bath, the following were found. Firstly, with Corrosionproof coating-2, the coating bath was left to stand at room temperature and about seven hours later, corrosion of the zinc powder in the coating started and evolution of bubbles from the coating bath started, and at the same time, gelation of the coating started, resulting in the deterioration of the film-forming property of the coating. Next, with Corrosionproof coating-1 and Corrosionproof coating-3, no change was seen in the physical properties of the coatings when the coating bath was left to stand at room temperature for one week. When zinc powder is uniformly blended in the coating to lower the electric potential of the coating film, if the coating employs an organic solvent, chemical stability can be retained and this coating can be practically used after leaving it for a long period of time. On the other hand, when the zinc powder is uniformly blended to a water-soluble coating, the coating bath was left to stand at room temperature and about seven hours later, corrosion of the zinc powder in the coating started and evolution of bubbles from the coating bath started, and at the same time, gelation of the coating started, resulting in the deterioration of the film-forming properties of the coating. Namely, the water-soluble coating having the zinc powder uniformly blended has a drawback that the lifetime of the coating bath is short. On the other hand, it has been found that when zinc phosphate powder is uniformly blended to the water-soluble coating, if the coating bath is left for a long period of time, the chemical stability can be maintained and a coating film having a low electric potential can be obtained.

Fin-and-tube type heat exchangers employing Corrosionproof coatings-1, 2 and 3, respectively, and the one of Comparative Example 4 having no coating on the hairpin tube, were installed in a refrigerating device of a room air conditioner, and as a result, it was found that no difference was seen in the cooling properties of the ones employing Corrosionproof coatings-1, 2 and 3, respectively, and the one of Comparative Example 4 having no coating on the hairpin tube. The feature of the corrosionproof coating film obtainable by coating Corrosionproof coatings-1, 2 and 3 containing a metal powder or a metal salt powder having a heat transmittance higher than that of a resin, resides in that since the metal powder or the like excellent in the heat transmittance is contained, the heat transmitting property is high as compared with the coating film containing no metal powder or metal salt powder. Accordingly, it has been found that the fin-and-tube type heat exchanger constituted by aluminium fins and hairpin tubes having the coating coated on the surface, is excellent in the heat transmission between the hairpin tubes and aluminium fins, and the reduction of properties of the fin-and-tube type heat exchanger can be controlled, and at the same time, the corrosion protection performance can be improved.

By the evaluation tests, the following have been recognized.

Firstly, since the coating film is shut out from the air, the corrosion such as pitting corrosion of metal pipes can be prevented, whereby the durability of the pipeline device can be improved. Secondly, since the pipeline device is constituted by aluminium fins and metal pipes of which the outer surface is provided with a corrosionproof film having a polarization potential lower than that of the metal pipes, the device is excellent in the heat exchanging efficiency and can be protected from the corrosion such as pitting corrosion of metal pipes for a pipeline of a refrigerant even under the circumstance where an acid or a salt is contained; and since the corrosionproof film does not undergo cathodic polarization against the metal pipes even if defects such as scratches or pin holes present at a part of the corrosionproof film layer, no corrosion such as pitting corrosion will occur and the durability of an air conditioner will be improved. The polarization potential value of the corrosionproof film of the coating is lower than the polarization potential value of copper, and the surface of the metal pipes having the corrosionproof film can be prevented from the formation of pitting corrosion and ants' nest-like corrosion. Besides, even if defects such as scratches or pin holes are present at the coating film, no corrosion will occur on the metal pipes by the effect of the coating film having a sacrificial corrosion effect, whereby the durability of the air conditioner can be improved. Thirdly, corrosion protection of the hairpin tube can be made without losing the heat exchanging property by coating the corrosionproof coating having the metal powder or the metal salt power blended on the surface of the hairpin tube of the fin-and-tube type heat exchanger.

In the present invention, the corrosion protection of copper pipes has been described. However, the same sacrificial corrosion effect can be obtained for the ones other than the copper pipes, such as iron pipes, and the same corrosion protection effect can be obtained even if the present invention is applied to pipelines for water supply using iron pipes, aluminium pipes or the like, or usual iron structures. Further, the present invention has been described with respect to tubes of a heat exchanger. However, it is quite natural that excellent heat dissipation and heat absorption and a high durability against corrosion can be obtained. Even if the structure of the present invention is applied to pipelines from a device to another device, or from an appliance to another appliance having no fins.

Moreover, in the embodiment of the present invention, the corrosion protection of copper pipes of the fin-and-tube type heat exchanger for air conditioners have been described. However, the present invention is by no means restricted to them. The present invention can be applied in various modified forms within a range not depart from the present invention, for example, the same effect can be obtained for copper pipe for feeding water or hot water or other metal materials. Further, the present invention can be applied to a device utilizing geothermal energy around which a corrosive gas such as hydrogen sulfide gas is present. Moreover, as a case where both a gas and a high humidity exist, areas along waterways of industrial zones wherein water hardly flows, may be mentioned. The structure of the present invention can be naturally applied only to necessary portions of the pipeline device installed in such areas. Description has been made with regard to the corrosionproof coating having the powdery material of a metal or a metal salt incorporated therein. However, the powdery material may be particles or thin pieces of a metal other than powder.

According to the first aspect of the present invention, since the metal pipe surface is shut out from the air by the corrosionproof coating film, the corrosion of the metal pipe such as pitting corrosion can be prevented and the durability of the device can be improved, whereby a highly reliable device can be obtained.

According to the second aspect of the present invention, corrosion can certainly be prevented.

According to the third aspect of the present invention, the pipeline device can be chemically stabilized and, even under the circumstance where an acid or a salt is contained, corrosion of the metal pipe such as pitting corrosion can certainly be prevented.

According to the fourth aspect of the present invention, it is possible to prevent pitting corrosion, ants' nest-like corrosion or the like and to prevent the corrosion of the metal pipe, and a device excellent in the heat transfer efficiency can be obtained.

According to the fifth aspect of the present invention, in the case where the step (a) is selected, since the powdery material of a metal or a metal salt has a polarization potential lower than that of the metal pipe material, even if defects such as scratches or pin holes are present on the coating film, it is possible to provide the sacrificial corrosion effect and to coat the coating in a uniform thickness on the pipe surface, and a surface layer excellent in the corrosionproof performance can easily be formed. Further, in the case where the step (b) is selected, since the powdery material of a metal or a metal salt has a polarization potential lower than that of the metal pipe material, a device free of the corrosion of the metal pipe can easily be produced.

According to the sixth aspect of the present invention, the chemical stability of the coating bath can be improved and it becomes possible to use the coating bath for a long period of time.

According to the seventh aspect of the present invention, it is possible to coat a highly viscous corrosionproof coating in a uniform thickness on the pipe surface in a short time, and the time for applying the corrosion protection can be shortened.

According to the eighth aspect of the present invention, a corrosionproof coating film excellent in the heat transfer can be formed and a device excellent in the corrosion protection effect and the heat transfer efficiency can be obtained.

According to the ninth aspect of the present invention, since a corrosionproof coating film excellent in the heat transfer is obtained, a heat exchanger having an excellent durability can be obtained.

According to the tenth aspect of the present invention, since a corrosionproof coating film excellent in the heat transfer is obtained, a heat exchanger having a high durability can be obtained.

What is claimed is:

1. A heat exchanger comprising:

a copper pipe configured to exchange heat with a fluid flowing in the copper pipe;

a plurality of fins fixedly contacted with an outer periphery of the copper pipe, the fins configured to exchange heat between the copper pipe and air outside the copper pipe; and a corrosionproof coating containing a mixture of a resin and a powder of a metal salt, the corrosionproof coating being directly coated on the outer periphery of the copper pipe, the metal salt having a polarization potential lower than a polarization potential of a material for the copper pipe.

2. The heat exchanger according to claim 1, wherein the fins are fitted to the outfit periphery of the copper pipe with the corrosionproof coating interposed.

3. The heat exchanger according to claim 1, wherein the corrosionproof coating comprises zinc phosphate as the metal salt.

4. The heat exchanger according to claim 3, wherein the corrosionproof coating comprises an alkylmelamine resin as the resin.

5. The heat exchanger according to claim 1, wherein the corrosionproof coating comprises an alkylmelamine resin as the resin.

6. The heat exchanger according to claim 5, wherein the corrosionproof coating comprises 20 wt % of the zinc phosphate.

7. A pipeline device comprising:

a copper pipe configured to be used in an appliance in a state that an outer periphery of the copper pipe is exposed to at least one of air, moisture and a corrosive gas, the copper pipe being configured to provide a passage for a refrigerant having a temperature lower than an outside temperature; and a corrosionproof coating containing a mixture of a resin and a powder of a metal salt, the corrosionproof coating being directly coated on the outer periphery of the copper pipe.

8. The pipeline device according to claim 7, wherein the metal salt has a polarization potential lower than a polarization potential of the copper pipe.

9. The pipeline device according to claim 7, further comprising a plurality of fins configured to transmit heat in the copper pipe to an outside of the copper pipe, the fins being provided in contact with the outer periphery of the copper pipe via the corrosion proof coating.

10. The pipeline device according to claim 7, wherein the resin comprises an alkylmelamine resin.

11. The pipeline device according to claim 10, wherein the metal salt comprises zinc phosphate.

12. The pipeline device according to claim 7, wherein the metal salt comprises zinc phosphate.

13. The pipeline device according to claim 12, wherein the corrosionproof coating comprises 20 wt % of zinc phosphate.

14. A method for producing a pipeline device, comprising the steps of:

forming into a desired shape a copper pipe to be disposed in a state that an outer periphery of the copper pipe is exposed to air or is contactible with moisture or a corrosive gas; and one of directly coating a corrosionproof coating containing a mixture of a resin and a powder of a metal salt on the outer periphery of the copper pipe and bringing a plurality of fins configured to transmit heat in the copper pipe to an outside of the copper pipe into contact with the outer periphery of the copper pipe; and fitting a plurality of fins configured to transmit heat in the copper pipe to an outside of the copper pipe to the outer periphery of the copper pipe and coating a corrosionproof coating containing a resin and a powder of a metal salt on the outer periphery of the copper pipe;

wherein the metal salt has a polarization potential lower than a polarization potential of the copper pipe.

15. The method for producing a pipeline device according to claim 14, wherein the metal salt comprises zinc phosphate.

16. The method for producing a pipeline device according to claim 15, wherein the resin comprises an alkylmelamine resin.

17. The method for producing a pipeline device according to claim 14, wherein the resin comprises an alkylmelamine resin.

18. The method for producing a pipeline device according to claim 15, wherein the corrosionproof coating comprises 20 wt % of zinc phosphate.

19. A method for producing a pipeline device, comprising the steps of:

forming into a copper pipe into a shape having an outer periphery of the copper pipe exposed to at least one of air, moisture, and a corrosive gas; and one of immersing the copper pipe in a thermoplastic resin in a molten state so as to directly coat a corrosionproof coating containing a mixture of a resin and a powder of a metal salt on the outer periphery of the copper pipe, the metal salt having a polarization potential lower than a polarization potential of the copper pipe and bringing a plurality of fins configured to transmit heat in the copper pipe to an outside of the copper pipe into contact with the outer periphery of the copper pipe; and fitting a plurality of fins configured to transmit heat in the copper pipe to an outside of the copper pipe to the outer periphery of the copper pipe and immersing the copper pipe in a thermoplastic resin in a molten state so as to coat a corrosionproof coating containing a resin and a powder of a metal salt on the outer periphery of the copper pipe, the metal salt having a polarization potential lower than a polarization potential of the copper pipe.

20. The method for producing a pipeline device according to claim 19, wherein the immersing step comprises immersing the copper pipe in the corrosionproof coating in a molten state.

21. The method for producing a pipeline device according to claim 19, wherein the corrosionproof coating comprises zinc phosphate as the metal salt.

22. The method for producing a pipeline device according to claim 19, wherein the corrosionproof coating comprises zinc phosphate as the metal salt.

23. The method for producing a pipeline device according to claim 22, wherein the corrosionproof coating comprises an alkylmelamine resin as the resin.

* * * * *

UNITED STATES PATENT AND TRADEMARK OFFICE

CERTIFICATE OF CORRECTION

PATENT NO. : 6,604,572 B2
DATED : August 12, 2003
INVENTOR(S) : Kawamoto

It is certified that error appears in the above-identified patent and that said Letters Patent is hereby corrected as shown below:

Title page,
Item [45] and the Notice information should read as follows:

-- [45] **Date of Patent: *Aug. 12, 2003**

[*] Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days. --

Signed and Sealed this

Ninth Day of December, 2003

JAMES E. ROGAN
*Director of the United States Patent and Trademark Office*